US006450083B1

(12) United States Patent
Dawson

(10) Patent No.: US 6,450,083 B1
(45) Date of Patent: Sep. 17, 2002

(54) TELESCOPIC HYDRAULIC HOIST

(75) Inventor: Steven Clare Dawson, Phelpston (CA)

(73) Assignee: Dawson Hydraulics Inc., Barrie (CA)

( * ) Notice: Subject to any disclaimer, the term of this patent is extended or adjusted under 35 U.S.C. 154(b) by 0 days.

(21) Appl. No.: 09/765,446

(22) Filed: Jan. 22, 2001

(51) Int. Cl.[7] ..... F01B 7/20
(52) U.S. Cl. ..... 92/53; 92/164
(58) Field of Search ..... 92/52, 53, 164

(56) References Cited

U.S. PATENT DOCUMENTS

| | | | | | |
|---|---|---|---|---|---|
| 2,308,761 | A | * | 1/1943 | Komph, Sr. | 92/52 |
| 2,364,741 | A | * | 12/1944 | Merchant | 92/52 |
| 2,783,744 | A | * | 3/1957 | Tennis | 92/52 X |
| 2,803,224 | A | * | 8/1957 | Wilson | 92/53 |
| 3,417,670 | A | * | 12/1968 | Madland | 92/52 |
| 3,958,376 | A | | 5/1976 | Campbell | |
| 4,303,005 | A | * | 12/1981 | Glomski et al. | 92/52 |
| 4,471,944 | A | | 9/1984 | Leray et al. | |
| 4,928,488 | A | | 5/1990 | Hunger | |
| 5,322,004 | A | * | 6/1994 | Sims | 92/52 |
| 5,390,586 | A | | 2/1995 | Jones | |
| 5,400,695 | A | * | 3/1995 | Walker | 92/53 X |
| 5,562,393 | A | | 10/1996 | Focke et al. | |
| 5,983,778 | A | | 11/1999 | Dawson | |

FOREIGN PATENT DOCUMENTS

| | | | | |
|---|---|---|---|---|
| AU | 209497 | * | 11/1956 | 92/53 |
| AU | 219001 | * | 11/1958 | 92/53 |
| AU | 81793/82 | | 9/1982 | F15B/15/16 |
| DE | 2157346 C2 | * | 2/1982 | 92/53 |
| DE | 85 14 857 | | 6/1985 | F15B/15/00 |
| DE | 41 08 207 | | 9/1992 | F15B/15/16 |
| FR | 2 290 613 | | 6/1976 | F15B/15/16 |
| FR | 2 433 121 | | 3/1980 | F15B/15/16 |
| GB | 771282 | * | 3/1957 | 92/53 |
| GB | 831000 | | 3/1960 | |
| GB | 1179944 | | 2/1970 | F15B/15/16 |
| GB | 2076894 A | * | 12/1981 | 92/53 |
| GB | 2 087 977 | | 6/1982 | F15B/15/16 |
| GB | 2 175 047 | | 11/1986 | F15B/15/17 |
| JP | 0021579 | * | 2/1977 | 92/53 |
| JP | 0107102 | * | 8/1980 | 92/53 |
| JP | 56-116905 | | 9/1981 | F15B/15/22 |

* cited by examiner

*Primary Examiner*—John E. Ryznic
(74) *Attorney, Agent, or Firm*—Dimock Stratton Clarizio; Mark B. Eisen

(57) ABSTRACT

A telescoping hydraulic hoist which improves stability and rigidity in the extended position without sacrificing the maximum extension length of the hoist and with fewer machined parts which may be dislodged or damaged in operation. The base member has a recess into which intermediate and inner tube stages recede when the hoist is in a fully collapsed position, and a stop-collar on the gland nut bearings overlaps the exposed end of the next broader tube stage, defining a limit of retraction for each intermediate tube stage, so that a tube stage when fully retracted contacts the exposed end of the next broader tube stage, thus dispensing with the need for stop rings.

17 Claims, 4 Drawing Sheets

FIG. 6.
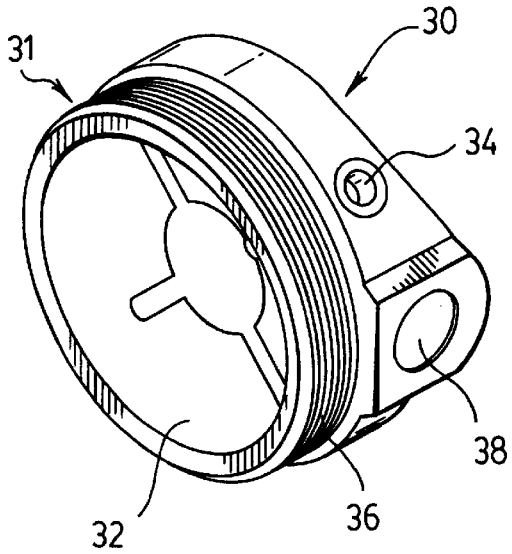
FIG. 7.
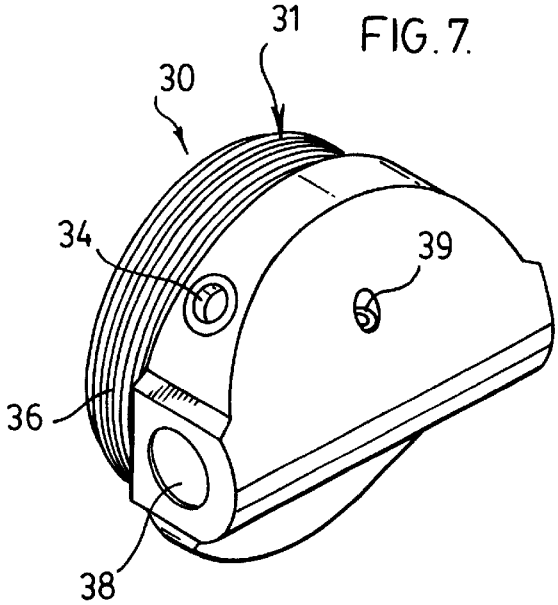
FIG. 8.
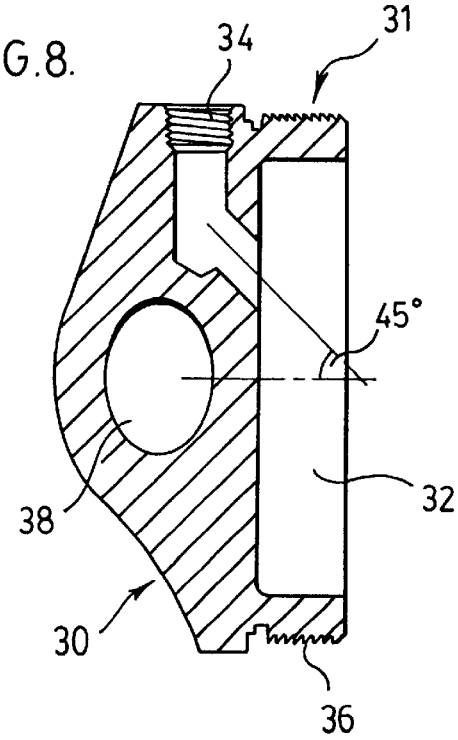
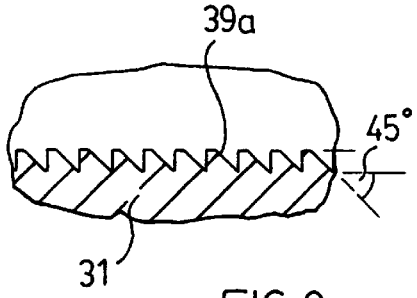
FIG. 9.

TELESCOPIC HYDRAULIC HOIST

FIELD OF THE INVENTION

This invention relates to hydraulic hoists. In particular, this invention relates to a telescopic hydraulic hoist having a plurality of telescoping tube stages.

BACKGROUND OF THE INVENTION

Telescopic hydraulic hoists are used in many applications. One popular use for telescopic hydraulic hoists is in heavy trucks, for example dump trucks, which require a strong, rigid lifting mechanism to raise the truck's container or bed for dumping heavy materials such as rubble, dirt, gravel etc.

U.S. Pat. No. 5,983,778 issued Nov. 16, 1999 to Dawson, entitled "Telescopic Hydraulic Hoist Apparatus," which is incorporated herein by reference, discloses a telescopic hydraulic hoist formed from a non-corrosive material such as aluminum. The hoist is provided with bearings and hydraulic seals about the bottom portion of each moving stage of the hoist. The bearings and seals are maintained within the hoist, and are thus not exposed to dust or particulate matter from outside the hoist. Air flows into and out of the air spaces between adjacent stages of the hoist through air breathers which are provided in gland nut bearings threadedly engaged to the exposed end of each tube stage.

The hoist disclosed in U.S. Pat. No. 5,983,778 may also include variable length stroke limiters, which limit the extension of the tube stages to varying degrees, and a cushion member which partially closes off the hydraulic inlet as the innermost stage is fully retracted to slow the hoist motion in the final stages of retraction. However, as is typical in telescopic hoist designs, the retracting movement of the various tube stages in the telescopic hoist is limited by the use of a stop ring inserted near the bottom of the inside diameter of each tube stage, which prevents further retraction of each moving stage once it has reached its fully collapsed position.

The stop ring may comprise a washer welded to the interior wall or a machined annular insert which is fitted into a groove circumscribing the interior wall of the tube stage. This presents a point of potential weakness in the hoist design, since in the former case the quality of the weld will affect the performance and durability of the tube stage, and in the latter case the groove creates a weak point around the tube wall. Also, the ring can become dislodged from the stage or otherwise distorted, causing a tube stage to fall through the next broader tube stage when the hoist is retracting and resulting in damage to the hoist.

Furthermore, the differential diameters of the tube stages affects the rigidity or stability of the hoist in the extended position. Given a constant wall thickness, as the diameter of each tube stage decreases, the length of the tube stage which can safely extend beyond the next broader tube stage also decreases. Increasing the wall thickness of the tube stages would enhance the stability of the hoist, but is not a desirable solution because it also increases the weight of the hoist.

One way to increase the stability of the hoist structure is to increase the overlap between adjacent tube stages of the hoist when the hoist is in its fully extended position. The greater the overlap between one telescopic stage and the next, the more rigid and stable is the structure of the extended hoist. However, increasing the overlap between adjacent tube stages correspondingly decreases the usable length of each tube stage and commensurately limits the maximum extension length of the hoist.

SUMMARY OF THE INVENTION

The present invention overcomes these disadvantages by providing a telescopic hydraulic hoist which improves stability and rigidity in the extended position without sacrificing the maximum extension length of the hoist. A hoist according to the invention improves stability by providing greater overlap between tube stages. The invention further eliminates the need for a stop ring, and thus provides a telescopic hydraulic hoist with fewer machined parts which may be dislodged or damaged in operation to thereby extend the life of the hoist, simplify assembly of the hoist, reduce the cost of the hoist components, and eliminate the weak point resulting from the inclusion of a groove or weld used to retain the stop ring in place in a conventional hoist by allowing the wall of the tube stage to be formed to a uniform thickness.

The invention accomplishes this by providing a base member having a recess into which intermediate and inner tube stages recede when the hoist is in a fully collapsed position. The invention also accomplishes this by providing a stop-collar on the gland nut bearings which defines a limit of retraction for each intermediate tube stage, the collar extending beyond an inner limit of the next broader tube stage so that a tube stage when fully retracted thus contacts the next broader tube stage, dispensing with the need for additional components such as stop rings.

The present invention thus provides a telescopic multistage hydraulic hoist, comprising a hydraulic fluid inlet in communication with an interior of the hoist, an inner tube stage having a contained end and an exposed end, at least one intermediate tube stage having a contained end and an open exposed end and comprising an intermediate gland nut bearing affixed to the exposed end of the at least one intermediate tube stage, the inner tube stage being disposed in the at least one intermediate tube stage in telescoping relation and being extendible through the open end of the at least one intermediate tube stage to an extended position and retractable through the open end of the at least one intermediate tube stage to a collapsed position, an outer tube stage having a first end and a second open end and comprising an outer gland nut bearing affixed to the open end of the outer tube stage and a base member affixed to the first end of the outer tube stage in sealed relation, the at least one intermediate tube stage being spaced from the outer tube stage by the outer gland nut bearing and being extendible through the open end of the outer tube stage to an extended position and retractable through the open end of the outer tube stage to a collapsed position, wherein the exposed end of at least the inner tube stage comprises a stop-collar which overlaps an exposed end of the at least one intermediate tube stage such that the stop-collar contacts the exposed end of the at least one intermediate tube stage when the inner tube stage is in a fully collapsed position.

The present invention further provides a telescopic multistage hydraulic hoist, comprising a hydraulic fluid inlet in communication with an interior of the hoist, an inner tube stage having a contained end and an exposed end, at least one intermediate tube stage having a contained end and an open exposed end and comprising an intermediate gland nut bearing affixed to the exposed end of the at least one intermediate tube stage, the at least one intermediate tube stage being disposed in a next broader tube stage in telescoping relation and being extendible through the open end of the next broader tube stage to an extended position and retractable through the open end of the next broader tube stage to a collapsed position, the inner tube stage being disposed in the at least one intermediate tube stage in telescoping relation and being extendible through the open end of the at least one intermediate tube stage to an extended position and retractable through the open end of the at least one intermediate tube stage to a collapsed position, an outer tube stage having a first end and a second open end and comprising an outer gland nut bearing affixed to the open end of the outer tube stage and a base member affixed to the first end of the outer tube stage in sealed relation, the at least one intermediate tube stage being spaced from the outer tube stage by the outer gland nut bearing and being extendible through the open end of the outer tube stage to an extended position and retractable through the open end of the outer tube stage to a collapsed position, the exposed end of at least the inner tube stage comprises a stop-collar which overlaps the exposed end of the next broader tube stage, wherein when the inner tube stage reaches a fully collapsed position the stop-collar of the inner tube stage contacts the exposed end of the next broader tube stage.

The present invention further provides a telescopic multi-stage hydraulic hoist, comprising a hydraulic fluid inlet in communication with an interior of the hoist, an outer tube stage having a first end and a second open end and comprising an outer gland nut bearing affixed to the open end of the outer tube stage, at least one intermediate tube stage disposed within the outer tube stage in telescoping relation, the at least one intermediate tube stage having a contained end and an exposed end and comprising an intermediate gland nut bearing affixed to the open end, the intermediate tube stage being extendible through the open end of a next broader intermediate tube stage or the outer tube stage to an extended position and retractable through the open end of the next broader intermediate tube stage or the outer tube stage to a collapsed position, an inner tube stage disposed within the at least one intermediate tube stage in telescoping relation, the inner tube stage having a contained end and an exposed end and being extendible through the open end of the at least one intermediate tube stage to an extended position and retractable through the open end of the at least one intermediate tube stage to a collapsed position, a base member affixed to the first end of the outer tube stage in sealed relation, the base member comprising a recess, and a stop structure for arresting the retraction of the inner tube stage, whereby the contained end of at least the inner tube stage recedes into the recess in the base member when the hoist is in a fully collapsed position.

In further aspects of the hoist of the invention: the stop-collars project from the gland nut bearings; each stop-collar contacts the gland nut bearing of the next broader tube stage; the gland nut bearings each comprise a wiper and a portion of the stop-collar of one tube stage which contacts the gland nut bearing of the next broader tube stage is provided with an annular recess into which the wiper of the next broader tube stage projects when the one tube stage is in the fully collapsed position; the base member comprises a recess, wherein the contained end of the inner tube stage recedes into the recess in the base member when the hoist is in a fully collapsed position; the hoist comprises a plurality of intermediate tube stages, wherein at least one intermediate tube stage recedes into the recess in the base member when the hoist is in a fully collapsed position; the base member is threadedly engaged to the outer tube stage; the base member comprises a neck bearing threads for engagement to the outer tube stage; and/or at least one of the intermediate tube stages abuts the neck of the base member when in the fully collapsed condition.

The present invention further provides a telescopic multi-stage hydraulic hoist, comprising a hydraulic fluid inlet in communication with an interior of the hoist, an outer tube stage having a first end and a second open end and comprising an outer gland nut bearing affixed to the open end of the outer tube stage, an inner tube stage disposed within the outer tube stage in telescoping relation, the inner tube stage having a contained end and an exposed end and being extendible through the open end of the outer tube stage to an extended position and retractable through the open end of the outer tube stage to a collapsed position, and a base member affixed to the first end of the outer tube stage in sealed relation, comprising a neck bearing threads for engagement to the outer tube stage, whereby the contained end of the inner tube stage abuts the neck of the base member when the hoist is in the fully collapsed condition.

BRIEF DESCRIPTION OF THE DRAWINGS

In drawings which illustrate by way of example only a preferred embodiment of the invention, FIG. 6 is a perspective view of a base member for the hydraulic telescopic hoist of FIG. 1A, FIG. 7 is a perspective view of the base member of FIG. 6 taken from the opposite side, FIG. 8 is a cross-sectional elevation of the base member of FIG. 6, and FIG. 9 is an enlarged elevation of a preferred thread configuration for the hoist of FIG. 1.

DETAILED DESCRIPTION OF THE INVENTION

Figure 1A:
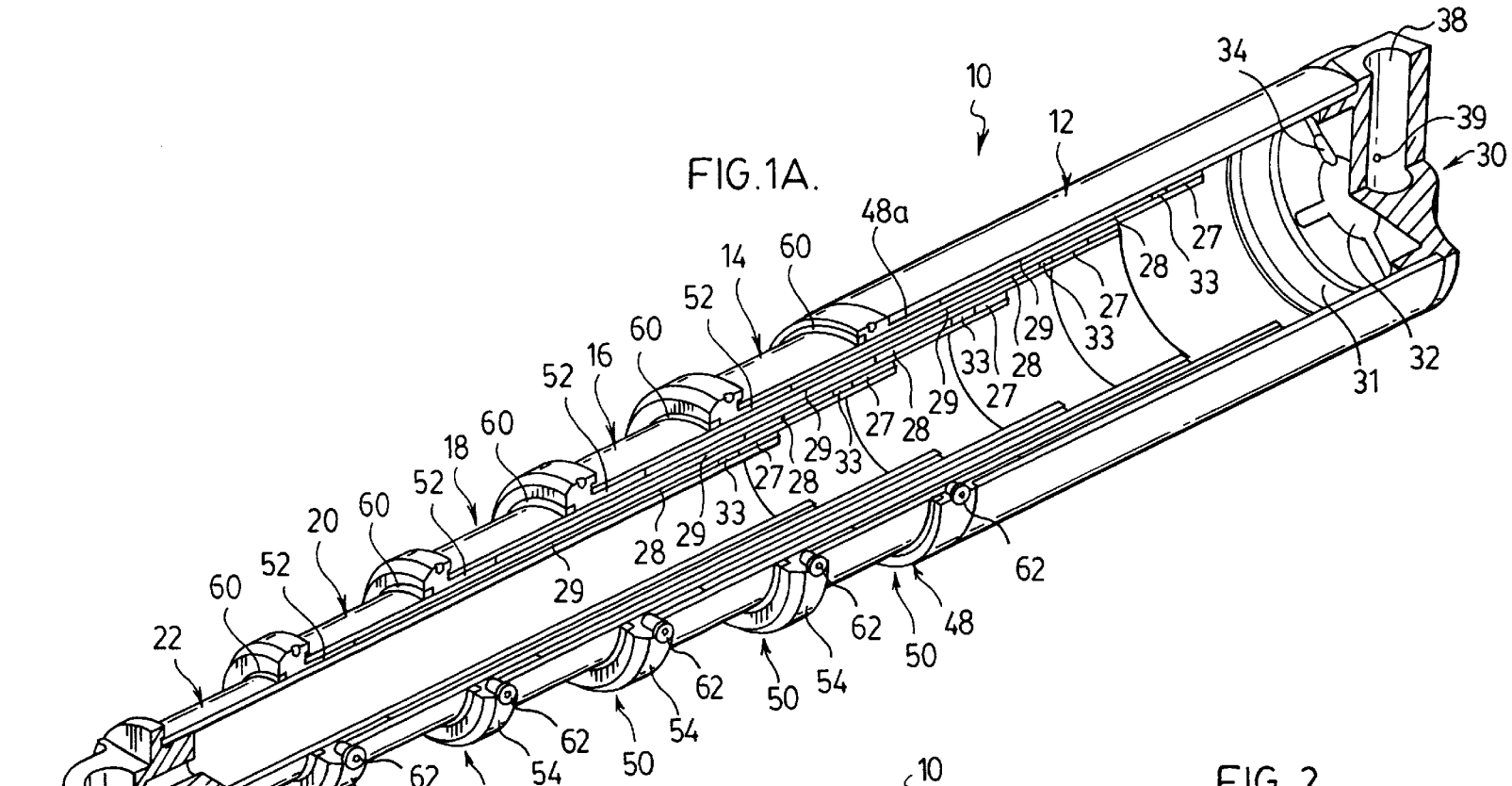
FIG. 1A is a partially cutaway perspective view of a telescopic hydraulic hoist according to the invention.
Figure 1B:
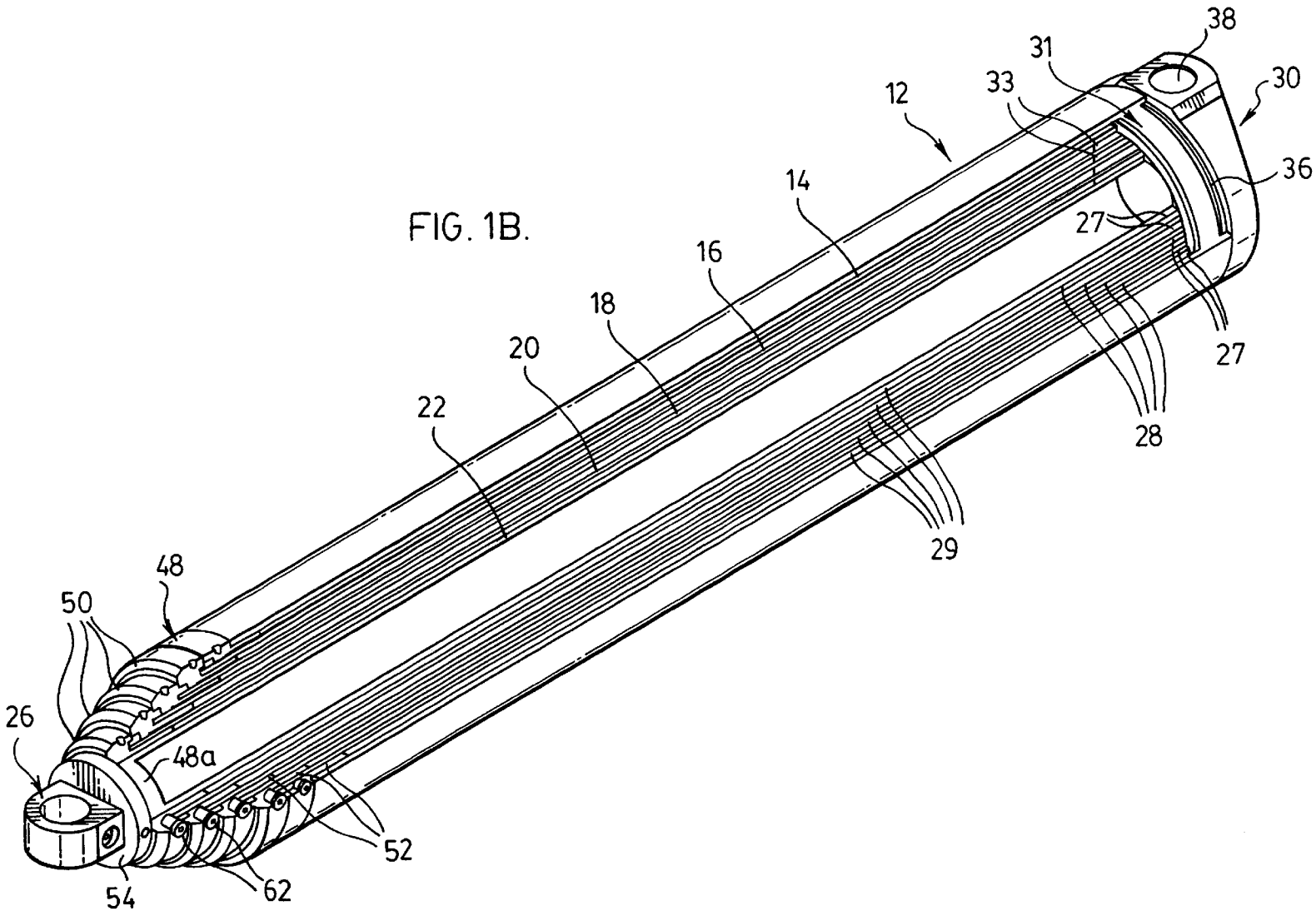
FIG. 1B is a partially cutaway perspective view of a telescopic hydraulic hoist of FIG. 1A in a fully collapsed position.

FIG. 1A illustrates a hydraulic hoist 10 in a partially extended position, having an outer tube stage 12, intermediate tube stages 14, 16, 18 and 20 and inner tube stage 22. (For purposes of clarity FIG. 1A shows each tube stage partially extended; in actual operation the tube stages extend one at a time until the hoist is fully extended.) FIG. 1B shows the hydraulic hoist 10 of FIG. 1A in the fully collapsed position.

Stroke limiters 28 affixed about the contained ends of each intermediate tube stage 14, 16, 18 and 20 and the inner tube stage 22 define the extension limit of each respective tube stage. The tube stages support bearings 27 (for example comprising wear bands) and seals 33 disposed between the tube stages prevent hydraulic fluid from flowing into air spaces 29 between the tube stages. The stroke limiters 28 may be of varying lengths as described in U.S. Pat. No. 5,983,778 issued Nov. 16, 1999 to Dawson, which is incorporated herein by reference, to allow differential extension lengths which accommodate decreasing strength or stability as the diameter of the tube stages decreases.

It will be appreciated that the number of stages and their dimensions are a matter of selection for any particular intended use. The hoist of the invention will be described and shown herein as having four intermediate tube stages 14, 16, 18 and 20 by way of example, however the invention is not intended to be limited thereby.

Figure 5:
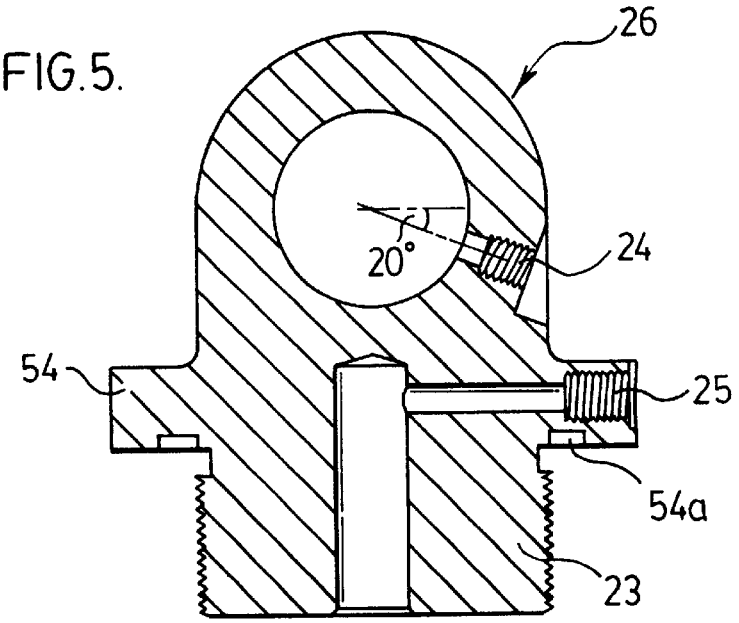
FIG. 5 is a cross-sectional elevation of a rod-eye for the inner tube stage.

Rod eye 26, shown in FIG. 5, is engaged (preferably threaded) to the exposed end of the inner tube stage 22 for attachment of the hydraulic hoist 10 to a load, for example the bed or frame of a dump truck (not shown), thereby enabling the bed of the dump truck to be elevated. Grease nipple 24 provides a conduit for applying grease to the rod eye 26, as is known, and air bleeder 25 is in communication with the interior of inner tube stage 22, allowing air to be bled from the hoist 10 when the hoist 10 is first filled with hydraulic fluid.

The outer stage 12 comprises a first end and a second open end. A base member 30 is affixed to the first end of the outer stage 12, in the preferred embodiment comprising a base member 30, illustrated in FIGS. 6 to 8. As shown the base member 30 includes a hydraulic fluid inlet 34 for feeding hydraulic fluid into interior of the hoist 10, and preferably has a threaded portion 36 about the neck 31 for threaded engagement to the first end of the outer tube stage 12, sealed by an O-ring (not shown). A threaded connection between the base 30 and the outer tube stage 12 is preferred because it is stronger than a conventional weld, reduces the labor required to assemble the hoist 10, and renders the hoist 10 easier to maintain and repair. As shown in FIG. 9, the preferred thread 31*a* is approximately 6 mm deep and of a 'saw tooth' configuration, sloping 2 and 45 degrees, has a pitch of 9 threads per inch, and has a truncated outer edge to reduce interference by grit and other particulate matter.

Pin hole 38 in base member 30 receives an anchoring pin (not shown) for anchoring the outer stage 12 of the hydraulic hoist 10 to the frame of the truck, and also includes a grease nipple 39. It will be appreciated that the hoist 10 is invertible, and thus either end can be mounted to the frame or to the load. It will also be appreciated that while it is convenient to provide the hydraulic fluid inlet 34 in the base member 30, it is also possible to position the hydraulic inlet 34 in another location in communication with the interior of the hoist 10.

Base member 30 is further provided with a recess 32. As can be seen in FIG. 1, in the fully collapsed position a portion of the contained end of each intermediate tube stage 16, 18 and 20, and inner tube stage 22, recedes into the recess 32 in the base member 30. This allows the intermediate tube stages 16, 18, 20 and inner tube stage 22 to be formed longer than the first intermediate stage 14, without increasing the minimum (fully collapsed) length of the hoist 10. Thus, when the hoist 10 is fully extended there is a greater overlap between adjacent tube stages, which increases the rigidity and stability of the hoist 10 in operation.

In the preferred embodiment the broadest intermediate stage 14 in the collapsed position abuts an annular neck 31 about the base member 30. The neck 31 forms a stop for the intermediate stage 14, which thus does not recede into the recess 32 in the base member 30.

The outer tube stage 12 comprises an outer gland nut bearing 48 affixed to the open end of the outer tube stage 12. The intermediate tube stages 14, 16, 18, and 20 each comprise intermediate gland nut bearing 50 respectively affixed to the exposed ends of intermediate tube stages 14, 16, 18, and 20. The gland nut bearings 48 and 50 provide a bearing surface which maintains each respective next narrower tube stage in concentric spaced relation from the open end of the outer tube stage 12 and the exposed ends of the intermediate tube stages 14, 16, 18 and 20. The contained ends of each tube stage 14, 16, 18 and 20 and the inner tube stage 22 are maintained in concentric spaced relation from the next broader tube stages 12, 14, 16, 18 or 20 by bearings 27 and seals 33, the bearings comprising for example conventional wear bands disposed in a shallow recess (not shown) about the outer wall of each tube stage 14, 16, 18, 20 and 22. Each tube stage thus slides through the gland nut bearing 48 or 50 of the next broader tube stage 12, 14, 16, 18 or 20, and bearings 27 and seals 33 slide along the interior wall of the next broader tube stage 12, 14, 16, 18 or 20, to thus move the tube stages 14, 16, 18, 20 and 22 in telescoping relation.

Figure 3:
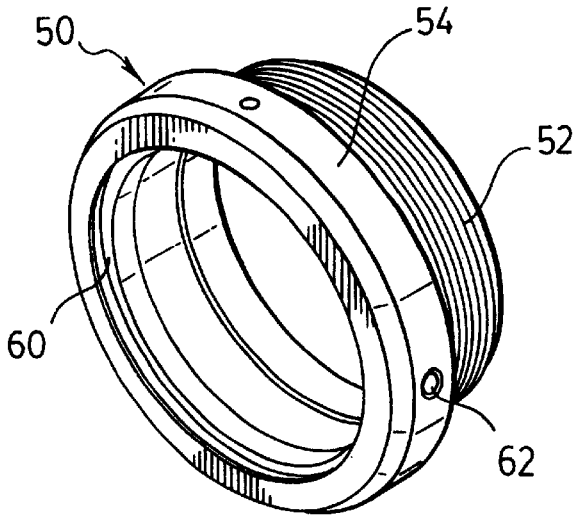
FIG. 3 is a perspective view of a gland nut bearing in the hydraulic telescopic hoist of FIG. 1A having a stop-collar.
Figure 4:
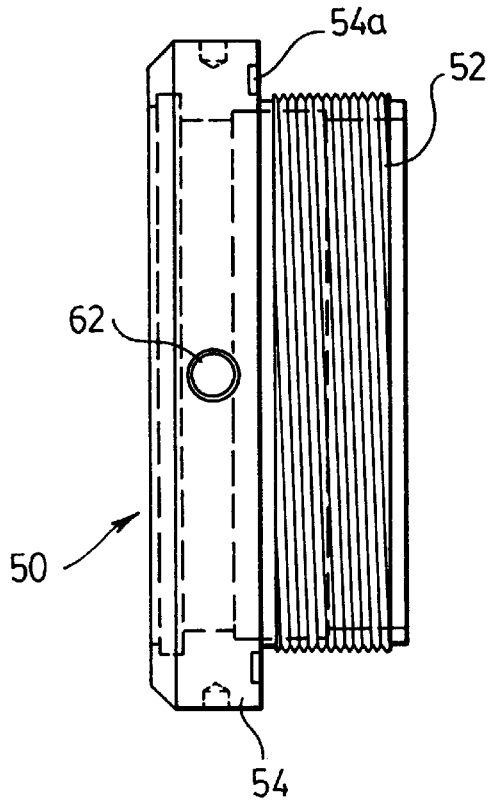
FIG. 4 is an elevation of the gland nut bearing of FIG. 3.

The gland nut bearing 48 has a threaded neck 48*a* for engagement to a threaded portion disposed about the inner wall of the open end of the outer tube stage 12. As shown in FIGS. 3 and 4, each intermediate gland nut bearing 50 has a threaded neck 52 for engagement to threaded portions respectively disposed about the inner walls of the exposed ends of the tube stages 14, 16, 18 and 20, and further comprises a stop-collar 54 which extends radially beyond the interior limit of the next broader tube stage, such that in the collapsed position illustrated in FIG. 1B the stop-collar 54 contacts the exposed end of the next broader tube stage, and in particular abuts against the exposed end of the gland nut bearing 50 (or 48) of the next broader tube stage. The rod eye 26 also comprises a stop-collar 54, which serves as a stop for the inner tube stage 22 by abutting against the exposed end of the gland nut bearing 50 affixed to the narrowest intermediate tube stage 20.

The outer gland nut 48 is affixed to the outer stage 12, which is stationary and therefore does not require a stop-collar. The broadest intermediate tube stage 14 also does not require a stop-collar 54, because in the embodiment shown the neck 31 forms a stop for the tube stage 14; however, the broadest intermediate stage 14 may be provided with a gland nut bearing 50 having a stop-collar 54, as shown in the drawings, for cosmetic purposes.

Affixed to the upper portions of gland nut bearings 48 and 50 are annular wipers 60, made of heavy duty rubber or another suitable material, to prevent dirt and other particulate contaminants from intruding into the spaces between adjacent tube stages. Locking screws (not shown) retain each gland nut bearing 48, 50, base member 30 and rod eye 26 in its respective tube stage 12, 14, 16, 18, 20 and 22, and thereby retain each of the tube stages with respect to the next broader tube stage. Each stop-collar 54 is provided with a shallow annular recess 54*a*, for example 1/16 inches deep, which in the collapsed position allows the collar 54 to abut the exposed end of the next broader tube stage (i.e., the exposed face of gland nut 48 or 50) without crushing the wiper 60 supported therein. The recess 54*a* also provides a reservoir for the deposit of any dirt pushed up by the wiper 60 of the next broader tube stage.

As described in U.S. Pat. No. 5,983,778, which is incorporated herein by reference, in the preferred embodiment air breathers 62 are provided for each of hydraulic tube stages 12, 14, 16, 18, and 20, illustrated in FIGS. 1 and 2, which allow air to flow out of and into the air spaces 29 between tube stages as the hoist 10 is respectively extended and collapsed. The air breathers 62 are preferably in communication with the respective air spaces 29 through a groove etched along the interior wall of the gland nut bearing 50, as described in U.S. Pat. No. 5,983,778.

Figure 2:
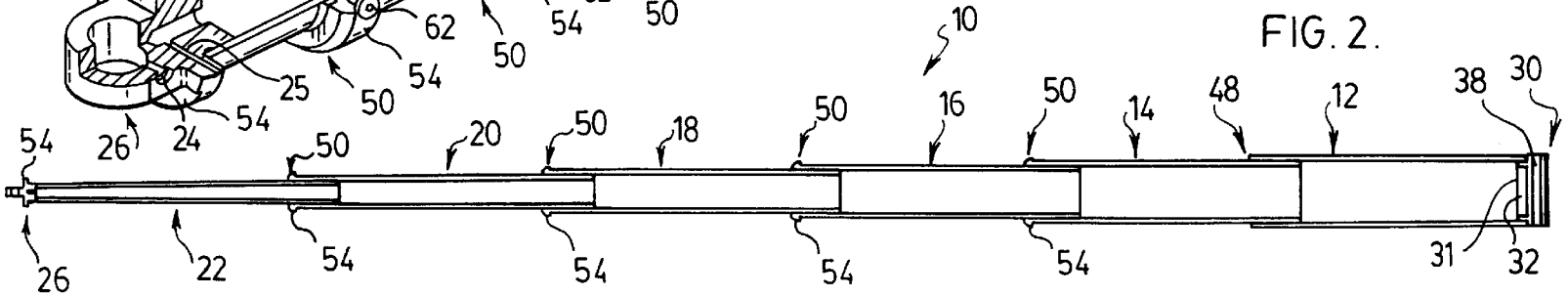
FIG. 2 is a cross-sectional elevational view of the hydraulic telescopic hoist of FIG. 1A in a fully extended position.

In operation, with the hoist 10 positioned between the frame and the load, for example the bed and the frame of a dump truck (not shown), and the rod eye 26 and pin hole 38 anchored thereto, pumping hydraulic fluid into the hoist 10 through fluid inlet 34 forces the hydraulic stages 14, 16, 18, 20 and 22 to extend from the collapsed position illustrated in FIG. 1B to the extended position illustrated in FIG. 2. As the hoist 10 extends and the stroke limiters 28 approach the gland nut bearings 48 or 50 of the next broader tube stage, air is forced out of the air spaces 29 between tube stages and egresses through air breathers 62.

As each tube stage 14, 16, 18, 20 and 22 reaches the fully extended position illustrated in FIG. 2, its respective stroke limiter 28 contacts the neck 52 of the gland nut bearing 50 of the next adjacent broader tube stage. For example, as the inner tube stage 22 reaches its full extension the stroke limiter 28 affixed around tube stage 22 abuts against the neck 52 of the gland nut bearing 50 affixed to intermediate tube stage 20; as the intermediate tube stage 20 reaches its full extension the stroke limiter 28 affixed around tube stage 20 abuts against the neck 52 of the gland nut bearing 50 affixed to intermediate tube stage 18; and so on. Thus, in the extended position, the overlap between adjacent tube stages is determined by the axial limits of the stroke limiters 28 and the necks 52 of the gland nut bearings 48 and 50.

When the hydraulic pressure is released the hoist 10 collapses from the extended position to the collapsed position shown in FIG. 1B, each intermediate tube stage 14, 16, 18, 20 and inner tube stage 22 is forced to retract by the weight of the truck bed or other load. The volume of the air spaces 29 increases as the stroke limiters 28 recede from their adjacent gland nut bearings 50, and air is drawn through the air breathers 62 into the air spaces 29. This prevents air from being drawn through the wipers 62, which would tend to suck particulate material into the air space 29 between tube stages which could damage the piston seal or the outer surface of the next broader tube stage. The air breathers 62 are preferably provided with filters to clean air as it is drawn into the air spaces 29 and prevent the intrusion of particulate matter between tube stages.

Because each stop-collar 54 overlaps the gland nut bearing 48 or 50 of the next broader tube stage, as the inner tube stage 22 and intermediate tube stages 16, 18 and 20 respectively reach a fully collapsed position the stop-collar 54 of the gland nut bearing 50 mounted on the collapsed tube stage contacts the exposed end of the next broader tube stage, which in the embodiment shown is the exposed end of the gland nut bearing 48 or 50 affixed to the next broader tube stage. Thus, when intermediate tube stage 20 is fully collapsed the stop-collar 54 of the gland nut bearing 50 affixed to tube stage 20 contacts the exposed end surface of the gland nut bearing 50 affixed to intermediate tube stage 18; when intermediate tube stage 18 is fully collapsed the stop-collar 54 of the gland nut bearing 50 affixed to intermediate tube stage 18 contacts the exposed end of the gland nut bearing 50 affixed to intermediate tube stage 16; and so on. The stop-collar 54 about rod eye 26 similarly extends radially so as to overlap the end of the next broader tube stage 20, to arrest the retraction of the inner tube stage 22 in like fashion. When the collars 54 of the rod eye 26 and all gland nut bearings 50 abut the respective next broader tube stage, and the contained end of the first intermediate tube stage 14 contacts the neck 31 of the base member 30, the hoist 10 is in the fully collapsed position.

As shown in FIG. 1B, in the fully collapsed position the contained ends of inner tube stage 22 and intermediate tube stages 16, 18 and 20 recede into the recess 32 formed in base member 30. In contrast with prior art hoist devices, in which the tube stages rest in staggered fashion on abutting stop rings, this allows the intermediate tube stages 16, 18, 20 and inner tube stage 22 to be made longer without increasing the length of the outer tube stage 12, and thus without increasing the length of the hoist 10 in the fully collapsed position. The increased lengths of the intermediate and inner tube stages 16, 18, 20 and 22 allows for greater overlap between tube stages in the fully extended hoist 10, and thus provides greater rigidity and stability. Also, the recessed base member 30 weighs considerably less than the solid base casting shown in U.S. Pat. No. 5,983,778.

It will be appreciated that while the hoist 10 of the invention advantageously comprises intermediate tube stages, the invention also contemplates a two-stage hoist 10 in which an inner tube stage 22 is disposed within the outer tube stage 12 in telescoping relation, extendible through the open end of the outer tube stage 12 to an extended position and retractable to a collapsed position. The base member 30 affixed to the outer tube stage 12 comprises a neck 31 bearing threads for engagement to the outer tube stage 12, and the contained end of the inner tube stage 22 abuts the neck 31 of the base member 30 when the hoist 10 is in the fully collapsed condition.

A preferred embodiment of the invention having been thus described by way of example, it will be appreciated by those skilled in the art that various modifications and adaptations may be made without departing from the scope of the invention, as set out in the appended claims. Further, while the invention has been described for purposes of example in the context of a dump truck, the invention may be used in many other applications and is not limited to the specific environment in which it has been so described.

I claim:

1. A telescopic multi-stage hydraulic hoist, comprising:

a hydraulic fluid inlet in communication with an interior of the hoist, an inner tube stage having a contained end and an exposed end, at least one intermediate tube stage having a contained end and an open exposed end and comprising an intermediate gland nut bearing affixed to the exposed end of the at least one intermediate tube stage, the inner tube stage being disposed in the at least one intermediate tube stage in telescoping relation and being extendible through the open end of the at least one intermediate tube stage to an extended position and retractable through the open end of the at least one intermediate tube stage to a collapsed position, the intermediate gland nut bearing comprising a wiper surrounding the inner tube stage to prevent contaminants from intruding into the space between the inner tube stage and the intermediate tube stage, an outer tube stage having a first end and a second open end and comprising an outer gland nut bearing affixed to the open end of the outer tube stage and a base member affixed to the first end of the outer tube stage in sealed relation, the at least one intermediate tube stage being spaced from the outer tube stage by the outer gland nut bearing and being extendible through the open end of the outer tube stage to an extended position and retractable through the open end of the outer tube stage to a collapsed position, wherein the exposed end of at least the inner tube stage comprises a stop-collar which projects from the gland nut bearing and overlaps an exposed end of the at least one intermediate tube stage such that the stop-collar contacts the gland nut bearing of the at least one intermediate tube stage, the portion of the stop-collar which contacts the gland nut bearing of the intermediate tube stage being provided with annular recess into which the wiper projects when the inner tube stage is in a fully collapsed position.

2. The hoist of claim 1 in which the base member comprises a recess, wherein the contained end of the inner tube stage recedes into the recess in the base member when the hoist is in a fully collapsed position.

3. The hoist of claim 2 in which the base member is threadedly engaged to the outer tube stage.

4. The hoist of claim 3 in which the base member comprises a neck bearing threads for engagement to the outer tube stage.

5. The hoist of claim 4 in which the at least one intermediate tube stage abuts the neck of the base member when in the fully collapsed condition.

6. A telescopic multi-stage hydraulic hoist, comprising:

a hydraulic fluid inlet in communication with an interior of the hoist, an inner tube stage having a contained end and an exposed end, at least one intermediate tube stage having a contained end and an open exposed end and comprising an intermediate gland nut bearing affixed to the exposed end of the at least one intermediate tube stage, the at least one intermediate tube stage being disposed in a next broader tube stage in telescoping relation and being extendible through the open end of the next broader tube stage to an extended position and retractable through the open end of the next broader tube stage to a collapsed position, the inner tube stage being disposed in the at least one intermediate tube stage in telescoping relation and being extendible through the open end of the at least one intermediate tube stage to an extended position and retractable through the open end of the at least one intermediate tube stage to a collapsed position, the intermediate gland nut bearing comprising a wiper surrounding the inner tube stage to prevent contaminants from intruding into the space between the inner tube stage and the intermediate tube stage, an outer tube stage having a first end and a second open end and comprising an outer gland nut bearing affixed to the open end of the outer tube stage and a base member affixed to the first end of the outer tube stage in sealed relation, the at least one intermediate tube stage being spaced from the outer tube stage by the outer gland nut bearing and being extendible through the open end of the outer tube stage to an extended position and retractable through the open end of the outer tube stage to a collapsed position, the exposed end of at least the inner tube stage comprises a stop-collar which projects from the gland nut bearing and overlaps the exposed end of the next broader tube stage, the portion of the stop-collar which contacts the gland nut bearing of the next broader tube stage being provided with an annular recess into which the wiper of the next broader tube stage projects when the one tube stage is in a fully collapsed position, wherein when the inner tube stage reaches a fully collapsed position the stop-collar of the inner tube stage contacts the gland nut bearing of the next broader tube stage.

7. The hoist of claim 6 comprising a plurality of intermediate tube stages in which the gland nut bearings each comprise a wiper, and a portion of the stop-collar of one tube stage which contacts the gland nut bearing of the next broader tube stage is provided with an annular recess into which the wiper of the next broader tube stage projects when the one tube stage is in the fully collapsed position.

8. The hoist of claim 6 in which the base member comprises a recess, wherein the contained end of the inner tube stage recedes into the recess in the base member when the hoist is in a fully collapsed position.

9. The hoist in claim 8 comprising a plurality of intermediate tube stages, wherein at least one intermediate tube stage recedes into the recess in the base member when the hoist is in a fully collapsed position.

10. The hoist of claim 8 in which the base member is threadedly engaged to the threads tube stage.

11. The hoist of claim 10 in which the base member comprises a neck bearing threads for engagement to the outer tube stage.

12. The hoist of claim 9 in which at least one of the intermediate tube stages abuts the neck of the base member when in the fully collapsed condition.

13. A telescopic multi-stage hydraulic hoist, comprising:

a hydraulic fluid inlet in communication with an interior of the hoist, an outer tube stage having a first end and a second open end and comprising an outer gland nut bearing affixed to the open end of the outer tube stage, at least one intermediate tube stage disposed within the outer tube stage in telescoping relation, the at least one intermediate tube stage having a contained end and an exposed end and comprising an intermediate gland nut bearing affixed to the open end, the intermediate tube stage being extendible through the open end of a next broader intermediate tube stage or the outer tube stage to an extended position and retractable through the open end of the next broader intermediate tube stage or the outer tube stage to a collapsed position, an inner tube stage disposed within the at least one intermediate tube stage in telescoping relation, the inner tube stage having a contained end and an exposed end and being extendible through the open end of the at least one intermediate tube stage to an extended position and retractable through the open end of the at least one intermediate tube stage to a collapsed position, a base member affixed to the first end of the outer tube stage in sealed relation, the base member comprising a recess and a neck threadedly engaged to the outer tube stage which forms a stop structure for a broadest intermediate tube stage, and a stop structure for arresting the retraction of the inner tube stage comprising a stop-collar projecting from a gland nut bearing affixed to the exposed end of the inner tube stage, whereby the contained end of at least the inner tube stage recedes into the recess in the base member when the hoist is in a fully collapsed position.

14. The hoist of claim 13 comprising a plurality of intermediate tube stages, in which at least one of the plurality of intermediate tube stages comprises a stop-collar.

15. The hoist of claim 14 in which the stop-collars contacts the gland nut bearing of the next broader tube stage.

16. The hoist of claim 15 in which the gland nut bearings each comprise a wiper, and a portion of the stop-collar of one tube stage which contacts the gland nut bearing of the next broader tube stage is provided with an annular recess into which the wiper of the next broader tube stage projects when the one tube stage is in the fully collapsed position.

17. A telescopic multi-stage hydraulic hoist, comprising:

a hydraulic fluid inlet in communication with an interior of the hoist, an outer tube stage having a first end and a second open end and comprising an outer gland nut bearing affixed to the open end of the outer tube stage, an inner tube stage disposed within the outer tube stage in telescoping relation, the inner tube stage having a contained end and an exposed end and being extendible through the open end of the outer tube stage to an extended position and retractable through the open end of the outer tube stage to a collapsed position, and a base member affixed to the first end of the outer tube stage in sealed relation, comprising a neck bearing threads for engagement to the outer tube stage, whereby the contained end of the inner tube stage abuts the neck of the base member when the hoist is in the fully collapsed condition.

* * * * *